US005491932A

United States Patent [19]

Elliott

[11] Patent Number: 5,491,932

[45] Date of Patent: Feb. 20, 1996

[54] HEIGHT VARYING APPARATUS AND METHOD FOR LAVATORY BASINS

[76] Inventor: Scott K. C. Elliott, 120 Brookside Ave., Cresskill, N.J. 07626

[21] Appl. No.: 322,295

[22] Filed: Oct. 4, 1994

[51] Int. Cl.[6] ..... A47K 3/16

[52] U.S. Cl. ..... 52/34; 52/36.4; 52/741.1; 248/188.4

[58] Field of Search ..... 52/34, 36.4, 721, 52/698, 704, 741.1; 248/188.4, 913, 287; 4/170, 167

[56] References Cited

U.S. PATENT DOCUMENTS 1,391,091 9/1921 Arbuckle ..... 248/243 X 1,657,020 1/1928 Mason ..... 4/646 X

*Primary Examiner*—Creighton Smith

*Attorney, Agent, or Firm*—Terrance L. Siemens

[57] ABSTRACT

A height varying apparatus is disclosed wherein a pair of partially threaded members are utilized. The first member is adapted to be screwed horizontally into an existing interiorly located wall mount, and the second member is adapted to be attached perpendicularly to the first. This second member has an aperture or a bore to receive the existing mounting posts that are attached to the basin or other object whose height it is desired to change. Thus, a sink that was attached to the wall mount can be raised with a minimum of intrusion into the wall saving time and money for the contractor or maintenance person required to do the job.

2 Claims, 2 Drawing Sheets

HEIGHT VARYING APPARATUS AND METHOD FOR LAVATORY BASINS

BACKGROUND OF THE INVENTION

1. Field of the Invention

The present invention relates to wall mounted fixtures. More specifically, it relates to wall mounted fixtures wherein the height needs perforce to be adjusted to allow for a barrier free environment such as are currently required to allow access by the handicapped to public facilities. More specifically, it relates to an apparatus that can be used to raise the height of the sink, basin, or like object without forcing the user to tear out the wall and backsplash panel to gain access to the support arms and adjustment devices thereinbehind. More generally, the present invention relates to any application where an object is supported by a fixture located behind a wall, and it is desired to adjust the height of the object with a minimum of construction and the associated downtime of the facility.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

A number of common devices exist for the installation of sinks, basins and the like in lavatories. All of these units are disposed behind the wall of the room, thus requiring a person who wishes to alter the height of the convenience to partially or totally dismantle the wall. This leads to a prolonged closing of the facility which, in the case of a public restroom, can lead to considerable inconvenience to the patrons of the facility. Additionally, the expense involved is not inconsiderable. Recently, laws have been proposed and passed that require a certain number of basins in public areas to be accessible to handicapped persons; i.e. that they must be a specified height above the ground to allow for the passage of a wheelchair. Retrofitting the facility to comply with these regulations can be a hardship to organizations that are already under budgetary strain. The present invention seeks to address this problem by providing an apparatus that allows the user to alter the height of the basin or sink without removing a large portion of the rear wall. A search at the U.S. Patent and Trademark Office revealed the following patents that relate to this field:

U.S. Pat. No. 1,391,091 issued to Emery H. Arbuckle on Sep. 20, 1921 discloses an adjustable sink. The sink is supported by a bracket that includes a number of lugs interengageable with a threaded vertical member. Unlike the present invention, there is no disclosure of engaging an existing structure behind the wall.

In U.S. Pat. No. 1,657,020 issued to Thomas Mason on Jan. 24, 1928 there is disclosed a lavatory support. This invention supports the basin through either a vertical support embedded in the wall, or an anchoring rod extending rearwardly of the support member through the wall and terminating in lateral flanges to guard against inadvertent tilting. Contrast this with the instant invention, which allows the user to adjust the light of the basin or other convenience without adjusting any portions of the support lying behind the wall facing.

U.S. Pat. No. 2,819,473 issued to Albert A. Baker et al. on Jan. 14, 1958 discloses a support for lavatories and the like wherein the main support includes feet embedded in the floor and the T-shaped arm supporting members attached thereto are held in their predetermined positions by set screws. This is dissimilar from the present invention in that the present invention is adapted to modify an existing support.

Lastly, U.S. Pat. No. 2,937,381 issued to Vincent T. Manas on May 24, 1960 discloses a carrier construction wherein duplex bracket structure allows for the back to back assembly of lavatory bowls or the like. This is clearly dissimilar from the present invention in that no post-construction height variation is taught without the wholesale tearing down of the wall behind which the support is located.

None of the above inventions and patents, taken either singly or in combination, is seen to describe the instant invention as claimed.

SUMMARY OF THE INVENTION

Briefly, the present invention comprises a pair of partially threaded members, the first member being adapted to be screwed horizontally into the existing interiorly located wall mount, and the second to be attached perpendicularly to the first. This second member has an aperture or a bore to receive the mounting posts attached to the basin or other object. Thus, a sink that was attached to the wall mount can be raised with a minimum of intrusion into the wall saving time and money for the contractor or maintenance person required to do the job.

Accordingly, it is a principal object of the invention to provide a new and improved adjustable addition to sink or basin mounts which overcomes the disadvantages of the prior art in a simple but effective manner.

It is a major object of this invention to provide an apparatus that allows the user to raise the height of an existing sink, basin, or other lavatory convenience without the necessity of tearing out a large portion of the wall behind it.

It is another object of the invention to provide an apparatus for adjusting the height of a sink, basin, or other lavatory convenience that fits into the standard, existing wall support.

It is another object of the invention to provide an apparatus for adjusting a sink or like object that consists of a minimal number of pieces for facilitating sale and transport.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
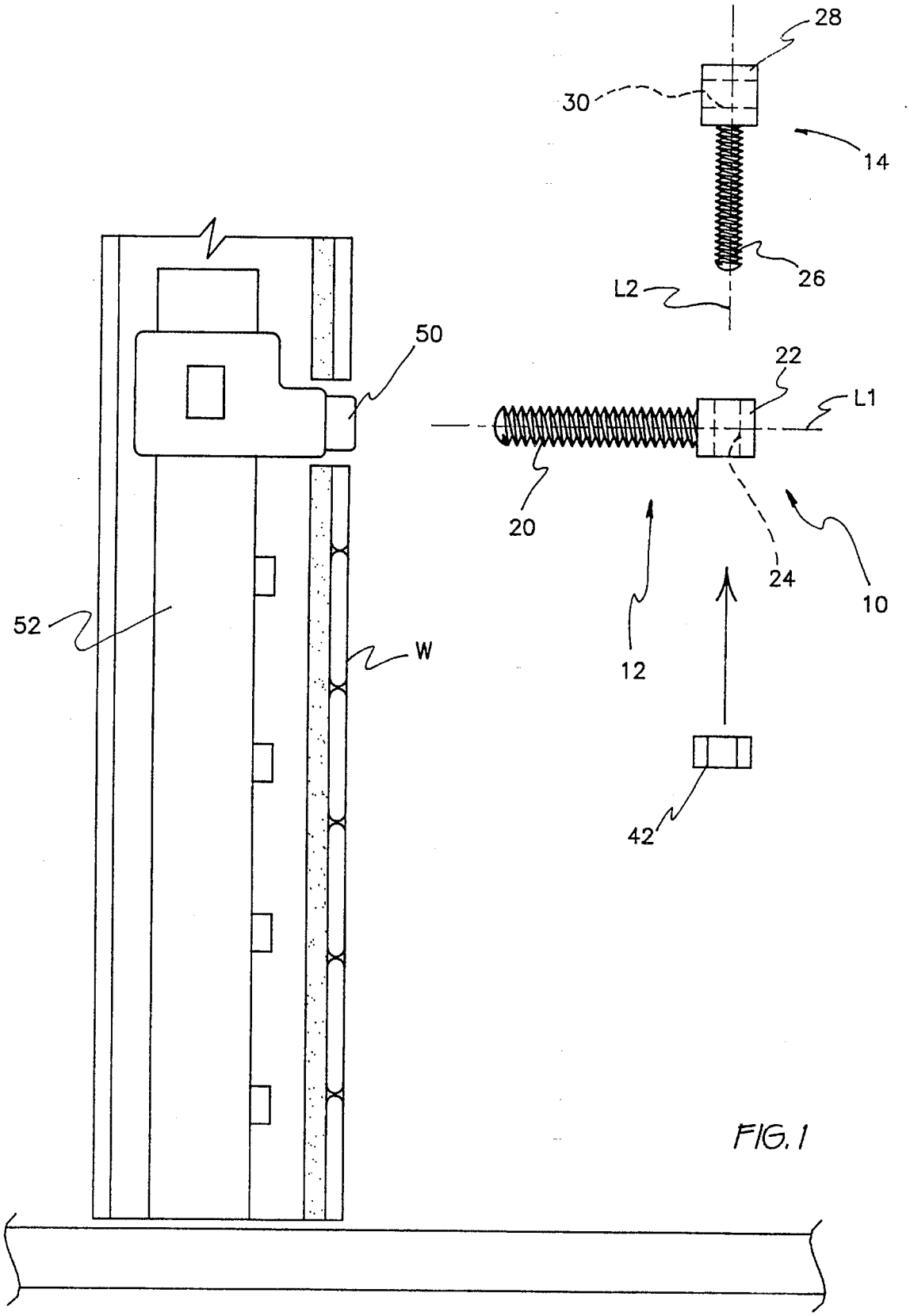
FIG. 1 is a cutaway side view inside of a wall showing the basin removed and the mounting collar exposed within the wall.
Figure 2:
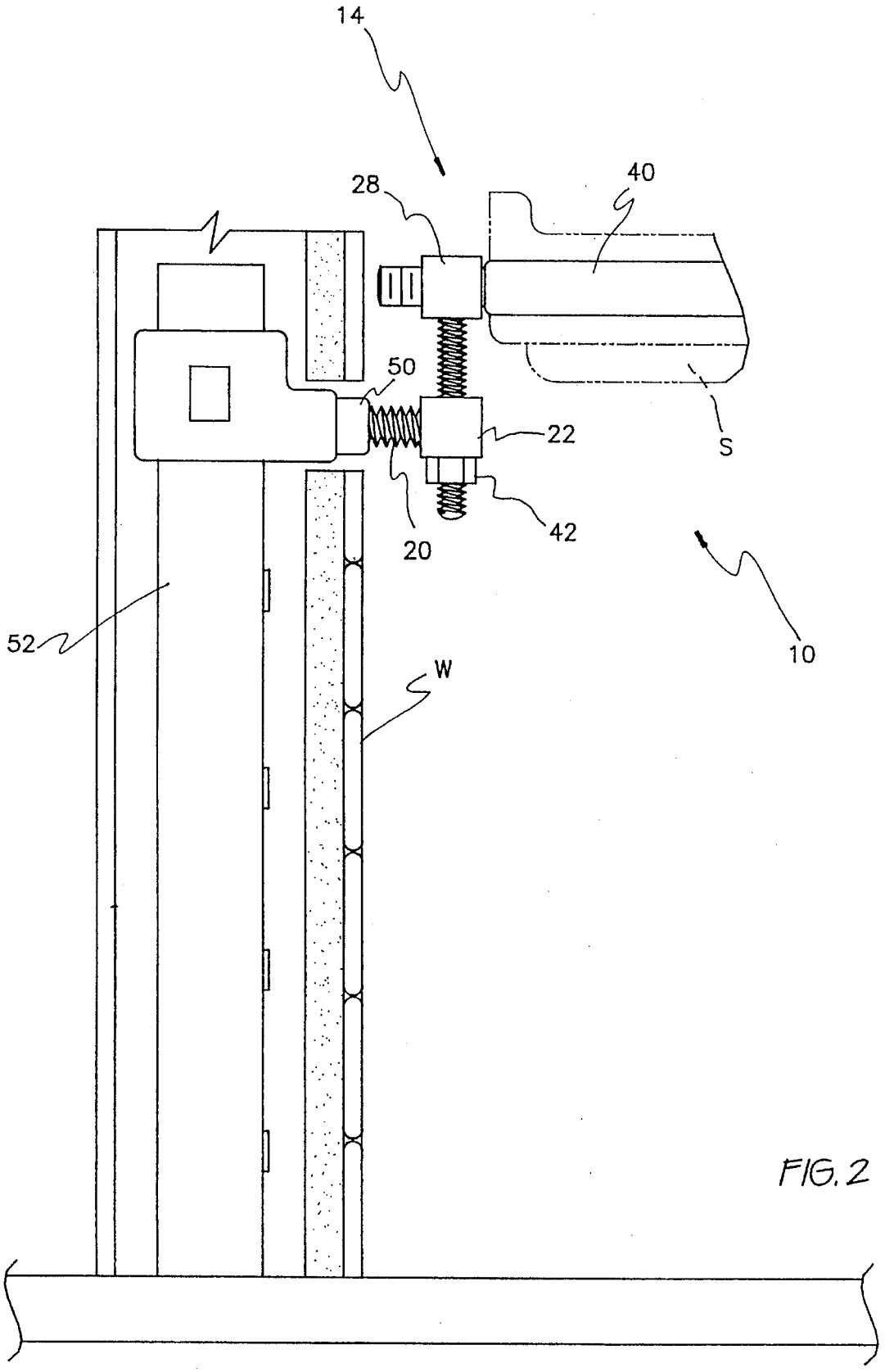
FIG. 2 is an enlarged view similar to FIG. 1 showing the instant invention in place and supporting the relocated basin.

The present invention is generally indicated at 10 in FIGS. 1 and 2. This improved height varying apparatus basically consists of two interengaging members. The first member 12, is adapted to fit into the mounting collar 50 inside the wall W. The second member 14, is adapted to perpendicularly engage the first member 12 and receive the basin support members 40 (as seen in FIG. 2). It should be noted that though in the figures only one interior wall support and set of interengaging members is shown, two are necessary to support the basin or like device and that, as one unit is described, the other is substantially the same.

The first interengaging member 12 is designed to be maintained in a generally parallel relationship to the floor when installed into the wall support as seen in FIG. 2. The member 12 has a threaded portion 20 and a head 22. The head has an aperture 24 therethrough. This aperture 24 is adapted to receive the threaded portion 26 of engagement member 14, as will be discussed further below. The aperture 24 is perpendicular to the longitudinal axis L1 (seen in FIG. 1) of the first engagement member 12.

The second engagement member 14 also has a threaded portion 26 and a head portion 28. Additionally, the second engagement member 14 includes an aperture 30 through the head portion 26 that is disposed perpendicular to the longitudinal axis L2 (also seen in FIG. 1) of the engagement member 14.

It should be noted that in the figures, the two engagement members that make up a set are depicted as being approximately the same size. This should not be construed as a limitation on the instant invention as it is contemplated that they could be of differing sizes, depending on the application to which they are applied, without departing from the spirit of the invention. The sizes, both of the engagement members 12, 14 themselves, their threaded portions 20, 26, the corresponding apertures 24, 30, and their head portions 22, 28 could be easily varied by the skilled artisan.

The discussion now turns to the manner in which the apparatus is used. Presumably, the user of the apparatus wishes to alter the height of a lavatory basin or other convenience. Formerly, this entailed removing a large portion of the wall W to gain access to each of the mounting collars 50 and the collar supports 52. With the present invention this wholesale destruction is not necessary. The gasket (not shown) behind the basin is removed, and the sink body S (shown in broken lines in FIG. 2) is then detached from the mounting collar 50. The first engagement member 12 is then attached to the mounting collar 50. In the preferred embodiment described herein, this attachment means is a threadable engagement. Other attachment means such as a friction fit or an adhesive could be used if desired. It is contemplated that the first member 12 could be shortened, if desired, by first measuring to determine the distance that the user wishes the sink or basin to extend out from the wall W and to the cut the member 12 at the appropriate point along the threaded portion 20. The first member 12 is then ready to receive the second member 14 by the insertion of the threaded portion 26 into the first member aperture 24. This is also accomplished by threaded engagement means in the preferred embodiment, however, as above, other engagement means could be used without departing from the spirit of the invention. The interengagement of the two members 12, 14 is fixed (in the preferred embodiment) my the tightening of a nut 42 onto the end of the threaded portion 26 that extends out of the aperture 24. Referring to FIG. 2, the apparatus 10 is now ready to receive the sink support members 40. The support members 40 are inserted into the second member aperture 28, thus providing a height variance for the sink in relation to the floor without requiring the maintenance personnel or contractor to break into the wall to effect the change. This height change can also be fine tuned or adjusted by the engagement between the first member aperture 24 and the second member threaded portion 24 by varying the depth to which the threaded portion 24 is inserted into the aperture before fixing it in place with the nut 42.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily use it to lower the height of a sink or basin instead of raising it as shown here. Thus a school could be retrofitted to serve younger children without expensive bathroom modification.

It is to be understood that the present invention is not limited to the sole embodiment described above; but encompasses any and all embodiments within the scope of the following claims:

I claim:

1. A height varying apparatus for a wall mounted object having at least one protruding support bracket, where the wall mounted object is detachably engaged through the support bracket to a wall mount disposed within the interior of the wall; and where the wall mount includes at least one support bracket receiving mouth generally perpendicular to the surface of the wall, comprising:

a first member having a first end, said first member first end including means to fixedly engage the bracket receiving mouth on the wall mount, and a second end distal to said first end including a first engagement aperture;

a second member having a second member first end, said second member first end including means to fixedly engage said first engagement aperture, said second member including a second member second end, distal to said second member first end, said second member second end including a second engagement aperture, said second engagement aperture adapted to receive the protruding support bracket extending from the wall mounted object; whereby the wall mounted object is detached from the interiorly located wall mount, said first member is fixedly engaged with the bracket receiving mouth such that said first member second end protrudes from the wall, said second member first end is fixedly engaged with said first engagement aperture such that said second member is generally parallel to the wall, and the bracket supports of the wall mounted object are introduced into said second engagement apertures on said second member, thus fixedly displacing the wall mounted object.

2. A method of varying the height of a wall mounted object having at least one protruding support bracket, where the wall mounted object is detachably engaged through the support bracket to a wall mount disposed within the interior of the wall, and where the wall mount includes at least one support bracket receiving mouth generally perpendicular to the surface of the wall, comprising the steps of:

removing the wall mounted object from the wall mount;

placing a first member into the wall mount support bracket receiving mouth such that it is generally perpendicular to the wall and protrudes therefrom;

engaging a second member with said first member such that said second member extends vertically and is generally parallel to the wall;

engaging the wall mounted object with said second member.

* * * * *